US007275955B2

(12) United States Patent
Ko

(10) Patent No.: US 7,275,955 B2
(45) Date of Patent: Oct. 2, 2007

(54) ELECTRICAL CONNECTOR ASSEMBLY

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/110,335

(22) Filed: Apr. 19, 2005

(65) Prior Publication Data

US 2006/0234542 A1 Oct. 19, 2006

(51) Int. Cl.
*H01R 12/24* (2006.01)

(52) U.S. Cl. ..... 439/498; 439/686; 439/701; 439/660

(58) Field of Classification Search ..... 439/495, 439/498, 499, 492, 686, 695, 724, 712, 714, 439/718, 752, 660, 722, 604, 701
See application file for complete search history.

(56) References Cited

U.S. PATENT DOCUMENTS 5,009,614 A * 4/1991 Fogg et al. ..... 439/695
5,906,504 A 5/1999 Igarashi et al.
5,975,917 A * 11/1999 Wang et al. ..... 439/701
6,475,026 B1 11/2002 Tseng et al.
6,589,068 B2 7/2003 Yu
6,623,299 B1 * 9/2003 Liu ..... 439/604
6,648,697 B2 * 11/2003 Yang ..... 439/752
6,672,905 B2 * 1/2004 Tharp et al. ..... 439/660

* cited by examiner

*Primary Examiner*—Felix O. Figueroa
(74) *Attorney, Agent, or Firm*—Wei Te Chung

(57) ABSTRACT

An electrical connector assembly (100) includes a first connector (200), a second connector (500) and an insulative base housing (1). The first connector includes a first housing (30) and a number of first terminals (20) fitted in and outwardly projecting from one end of the housing. The second connector has a second insulative housing (31) and a number of second terminals (21) fitted in and extending beyond one end of the second housing. The base housing includes a first holding portion for supporting the first connector and a second holding portion for supporting the second connector. The base housing defines an accessible mating interface (10) having a number of passages (122) are arranged in a first row and a second row to respectively dispose the first terminals and the second terminals.

2 Claims, 8 Drawing Sheets

ELECTRICAL CONNECTOR ASSEMBLY

BACKGROUND OF THE INVENTION

1. Field of the Invention

The present invention generally relates to an electrical connector assembly, and more particularly to a Flat Flexible Cable (FFC) connector assembly.

2. Description of Related Art

Flat Flexible Cables (FFC) are widely used to connect components, such as a printed circuit board, arranged in a confined space inside an electronic device, such as a computer, for deducing the overall size of the electronic device. A conventional FFC connector usually comprises an insulative housing defining a receiving cavity for movably receiving an actuator. The actuator has a tongue insertable into the receiving cavity and a top face for retaining a leading end of a flat flexible cable, whereby, when the tongue is inserted into the cavity, the flat flexible cable engaged with rear cantilevered arms of electrical contacts accommodated in the receiving cavity. Moreover, each contact comprises forward cantilevered arms opposite to the rear arms for electrically connecting with terminals of a complementary connector, which is mounted on a printed circuit board, so as to established electrical connection between two electronic devices. For this reason, the contact of the FFC connector has a relative complicated structure, which is difficult to be fabricated and assembled. Accordingly, the FFC connector is designed to have a relative large overall dimension for disposing the contacts with complicated structure and the actuator therein. However, when it is required two or more FFCs to the printed circuit board, a corresponding number of connectors are needed, and thus, occupy more space on the printed circuit board.

Hence, an improved FFC connector assembly is needed to overcome the disadvantages of the related art.

SUMMARY OF THE INVENTION

Accordingly, an object of the present invention is to provide an electrical connector assembly adapted for connecting two or more flexible flat cables as well as maintaining a low profile.

In order to achieve the object set forth, an electrical connector assembly in accordance with present invention comprises a first connector having a first insulative housing, second connector and an insulative base housing. The first connector comprises a first housing and a plurality of first terminals fitted in and outwardly projecting from one end of the housing. The second connector has a second insulative housing and a plurality of second terminals fitted in and extending beyond one end of the second housing. The base housing comprises a first holding portion for supporting the first connector and a second holding portion for supporting the second connector. The base housing defines an accessible mating interface having a plurality of passages are arranged in a first row and a second row to respectively dispose the first terminals and the second terminals.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
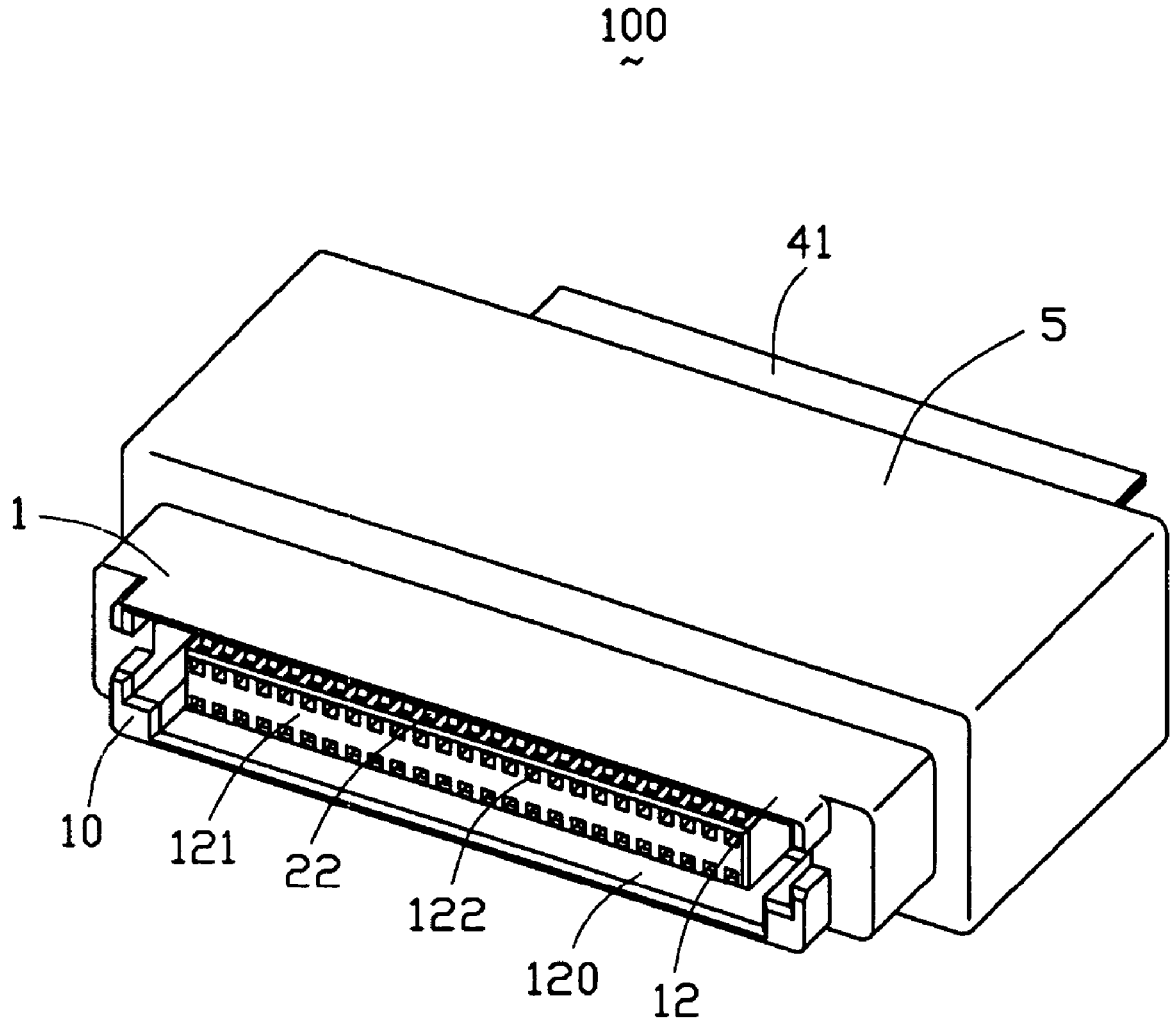
FIG. 1 is an assembled, perspective view of an electrical connector assembly in accordance with the present invention.
Figure 2:
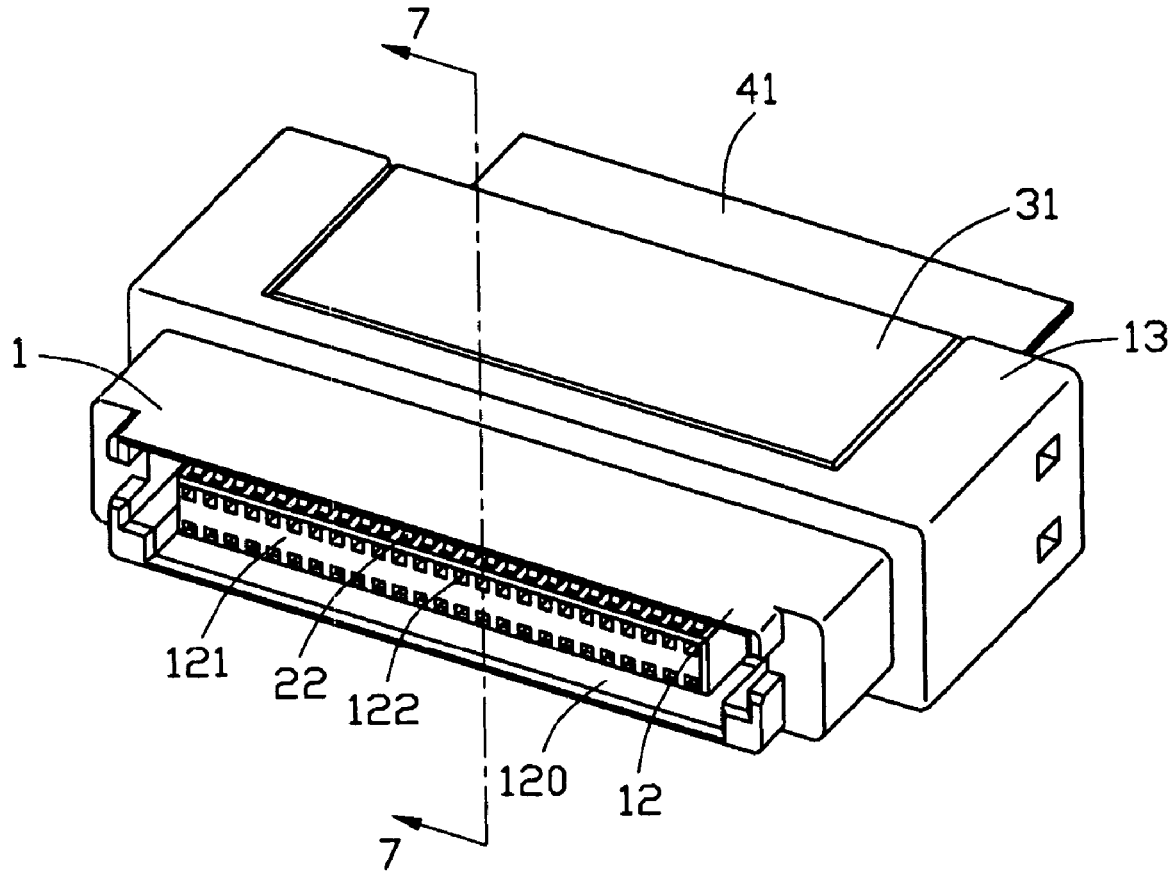
FIG. 2 is an assembled, perspective view of a cable assembly without a cover shown in FIG. 1.
Figure 5:
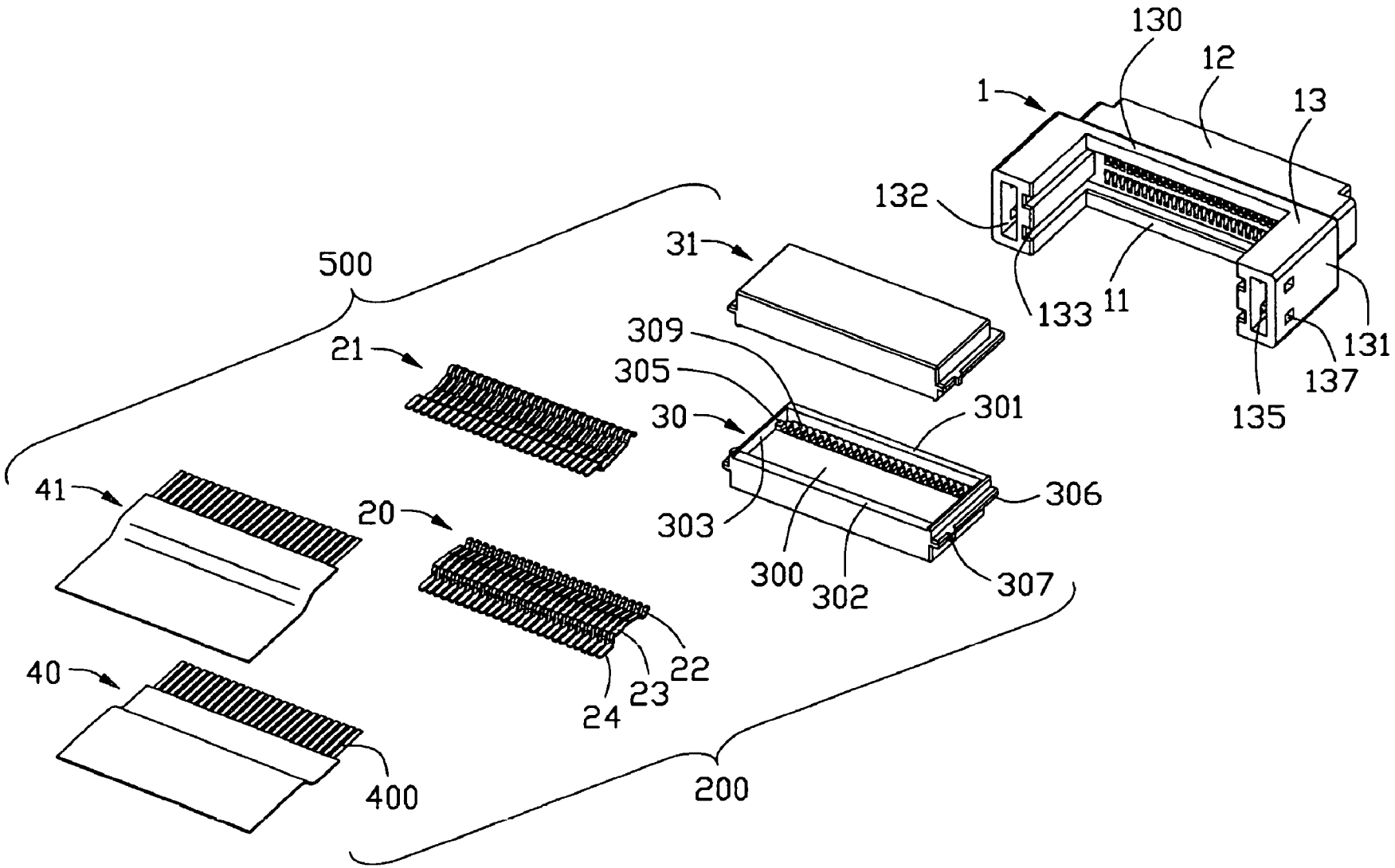
FIG. 5 is a view similar to FIG. 4, but taken from a different aspect.
Figure 6:
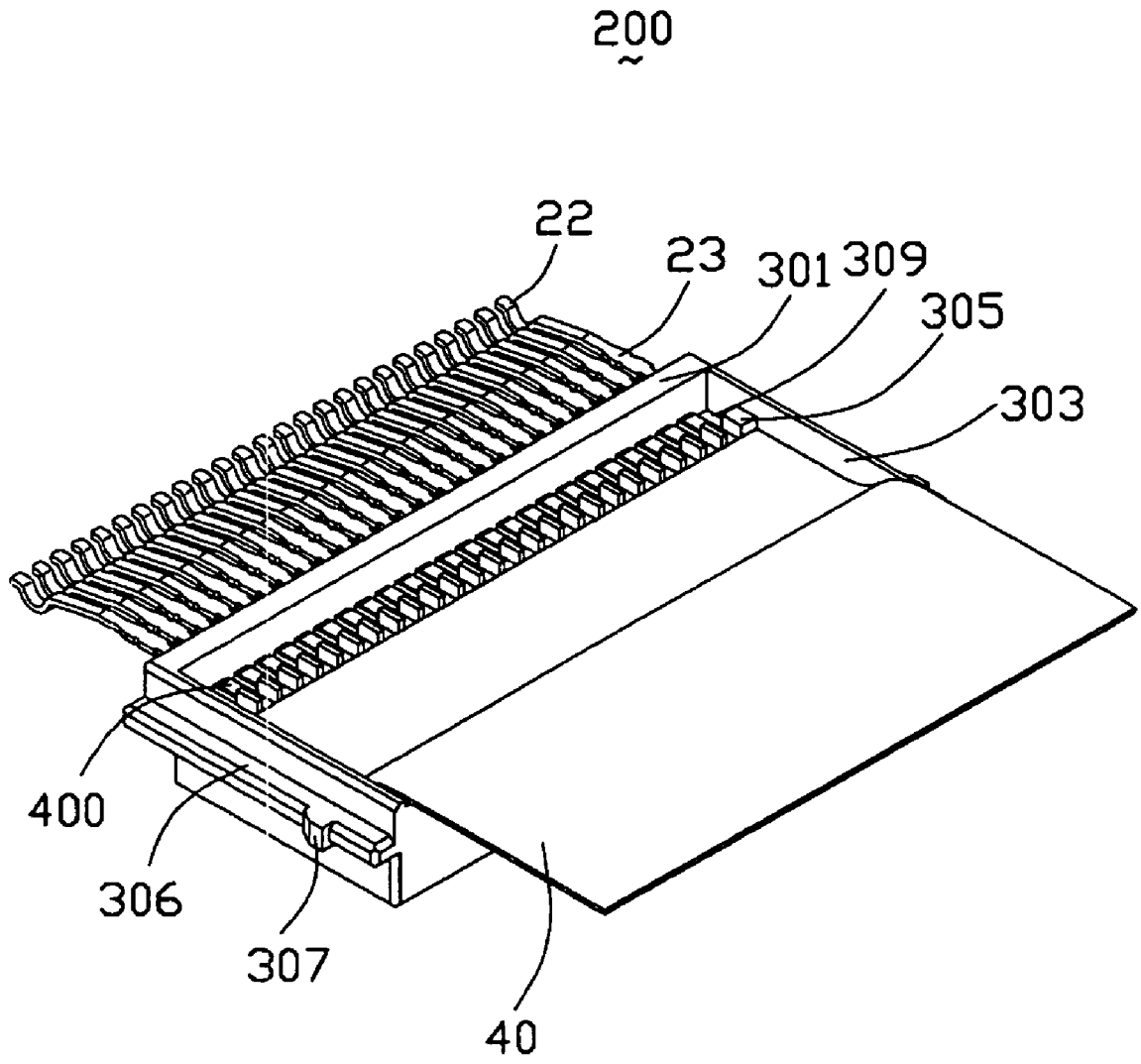
FIG. 6 is a partially assembled, perspective view of a first connector shown in FIG. 5.

Referring to FIG. 1 and FIG. 5, an electrical connector assembly 100 in accordance with the present invention comprises a bracket-shape insulative base housing 1, a first connector 200 and a second connector 500, both of which are assembled to the base housing 1.

Figure 4:
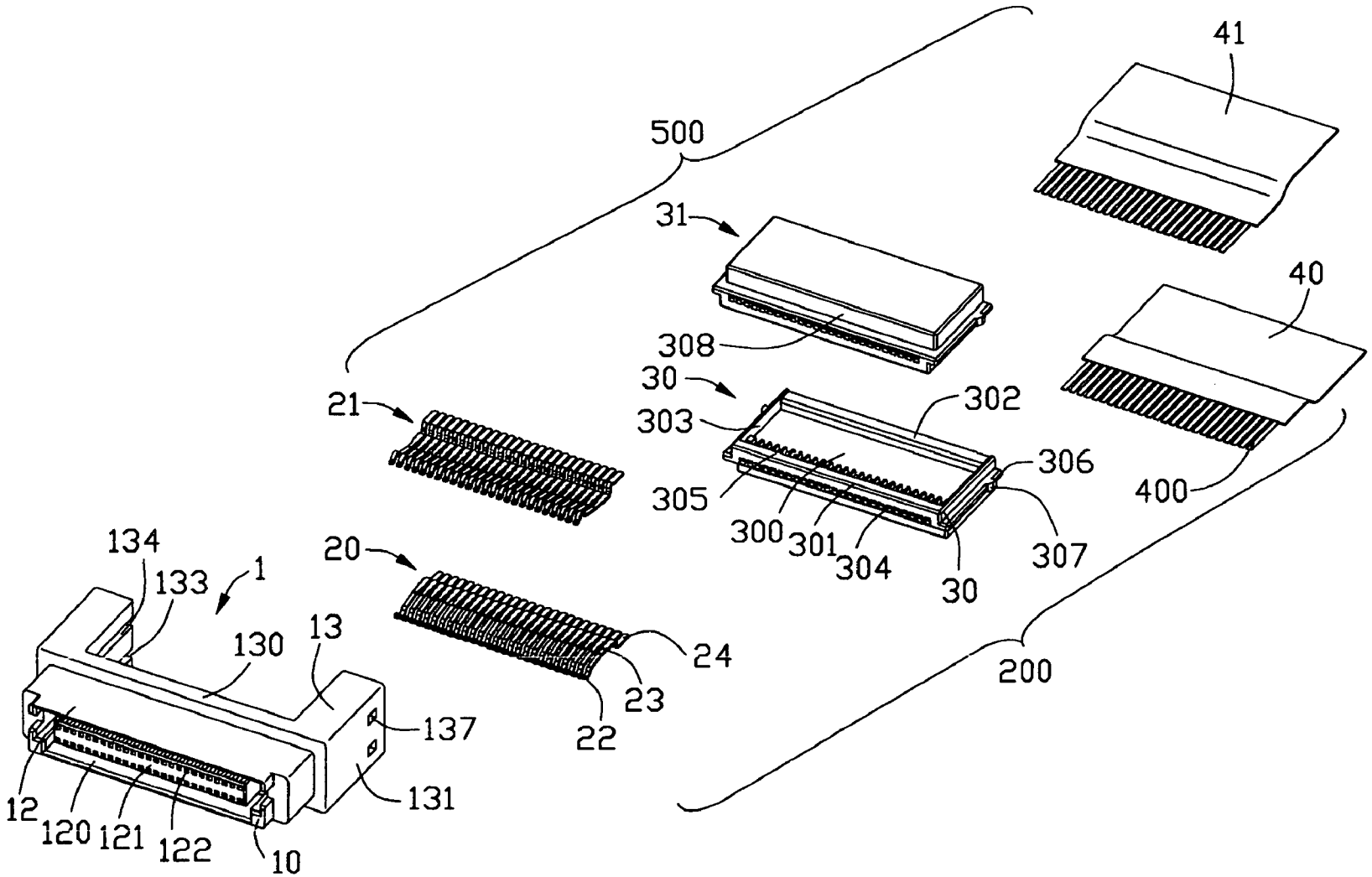
FIG. 4 is an exploded, perspective view of the cable assembly shown in FIG. 2

Referring to FIG. 4 and FIG. 5, the base housing 1 comprises a rectangular mating portion 12 defining a mating interface 10 of the connector assembly 100 and an U-shape engaging portion 13 extending rearwardly from the mating portion 12 and comprising a first holding portion (not labeled) and a second holding portion (not labeled). The mating interface 10 is defined by a receiving cavity 120 for receiving a portion of a complementary connector (not shown) and a tongue board 121 formed in the center of the receiving cavity 120. The tongue board 121 defines a plurality of passages 122 extending therethrough. The passages 122 are arranged in an upper row and a lower row in a lengthwise direction of the tongue board 121. The engaging portion 13 comprises an outward flange 130 surrounding the mating portion 12 and a pair of arm portions 131 rearwardly extending from two opposite ends of the outward flange 130. A rear face of the outward flange 130 is defined as a connection face 111 of the base housing 1. The arm portions 131 define a pair of opposite first channels 133 in inner side surface thereof and a pair of second channels 134 respectively located above the first channels 133. Each arm portion 131 further defines a rear opened slot 132, a first aperture 135 in communication with corresponding first channel 133 and the slot 132, a second apertures (not labeled) in communication with corresponding second channels 134, and a pair of third apertures 137 in out side surface in communication with the slot 132.

Figure 3:
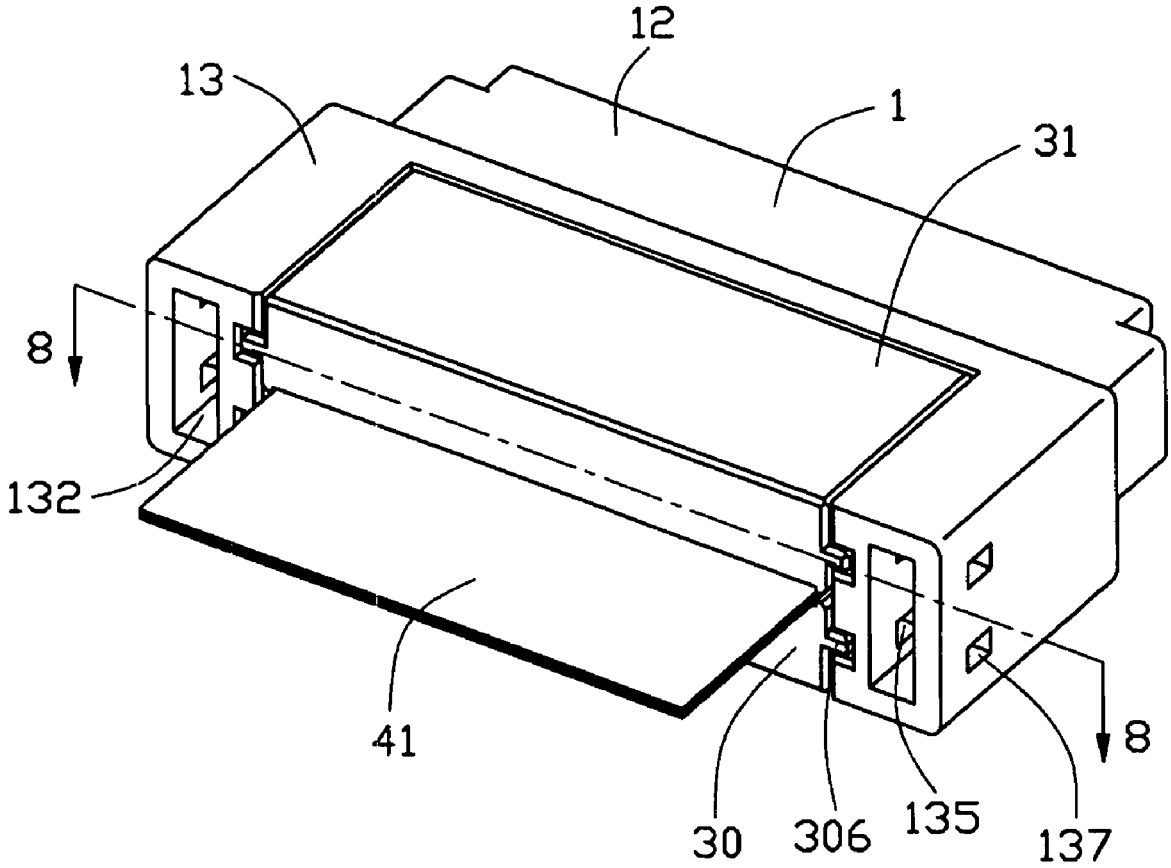
FIG. 3 is a view similar to FIG. 2, but taken from a different aspect.

Referring to FIGS. 3-5, as the first connector 200 and the second connector 500 are designed in the substantially same structure in the preferred embodiment, only the first connector 200 will be described in great detail hereafter. The first connector 200 comprises a block shape insulated first housing 30, a set of first terminals 20 assembled to the first housing 30 and a flat flexible first cable 40 solderable to the first terminals 20. Each first terminal 20 comprises a contacting portion 22, an opposite tail portion 24 and a retaining portion 23 with barbs (not labeled) thereon located between the contacting portion 22 and the tail portion 24. The first housing 30 forms a front flange 301, a rear flange 302 and a pair of side flanges 303 extending between the front and the rear flanges 301, 302, the front, rear and side ranges 301, 302, 303 together define a depression 300 on one side thereof. The front flange 301 defines a plurality of through holes 304 respectively in alignment with corresponding rear openings (not labeled) of the passages 122 of the lower row of the base housing 1. A plurality of partition portions 305 are formed on a bottom surface of the depression 300. A spare space 309 is provided between the front flange 301 and front ends of the partition portions 305 for receiving the first terminals 20 and the first cable 40. A pair of positioning portions 306 are formed on opposite lateral sides of the first housing 30, each of which has an outwardly protruding protrusion 307 at a rear portion thereof. A stepped portion 308 is formed at the front end of the first housing 30 below the through holes 304. The first terminals 20 are assembled to the first housing 30, with the tail portions 24 passing through corresponding through holes 304 and received in the spare space 309, and with the retaining portions 23 and the contact portions 22 extending beyond the front end of the first housing 30. The first cable 40 comprises a plurality of conductors 400, moreover, front portions of the conductors 400 are exposed for later soldering process. A front portion of the first cable 40 is fittingly fitted in the depression 300, the exposed conductors 400 are respectively laid on corresponding tail portions 24 of the first terminals 20 and separated from each other by the partition portions 305. The first terminals 20 and the conductors 400 of the first cable 40 are then aligned in the spare space 309 and soldered together by hot bar process with good soldering quality. The second connector 500 comprises an insulative second housing 31, a set of second terminals 21 fixed to the second housing 31 and a second flat flexible cable 41 soldered to the second terminals 21.

Referring to FIGS. 1-3 and FIGS. 4-8, the first and the second connectors 200, 500 are assembled to the base housing 1 from a rear side in a mirror-image disposition relative to a line between the first connector 200 and the second connector 500. The positioning portions 306 of the first connector 200 are fittingly inserted into the first channels 133 with the protrusions 307 sliding into the first apertures 135 so as to prevent the first and the second connectors 200, 500 from rearward/frontward moving relative to the base housing 1. In this view, the pair of first channels 133 are functioned as the first holding portion for supporting the first connector 200, and the pair of second channels 134 are functioned as the second holding portion for holding the second connector 500. The set of first terminals 20 and the set of the second terminals 21 are respectively inserted into corresponding passages 122 in the lower and upper rows with the contacting portions 22 exposed into the receiving cavity 120 to electrically contacting with contact portions (not shown) of the complementary connector. Thus, the rear openings of passages 122 are substantially sealed by the first and the second terminals 20, 21 and the front flanges 301 of the first and second housings 30, 31. The stepped portions 308 of the first housing 30 and the second housing 31 are intimately in contact with the rear face 11 of the base housing 1. Further, in preferred embodiment of the present invention, the portions exposed outside the first housing 30 and the second housing 31 of the first and the second cables 40, 41 are aligned in a line to be laminated and bonded in one. An insulated cover 5 is then provided for molding over the engaging portion 13 of the base housing 1, the first connector 200 and the second connector 500 with the two in one cable 4 exposed. During molding process of the cover 5, melted insulated material flows into the slots 132 of the base housing 1 so that the cover 5 is reliably engaged with the base housing 1 when the insulated material is cooled.

In other embodiments of the present invention, the first connector 200 and the second connector 500 could have different structures for meeting demands of various applications. In addition, the first and the second terminals 20, 21 can be electrically connected to other connecting member, e.g. flexible printed circuit, printed circuit board or common cables, in permanently/impermanently connection manners. Besides, although the first and the second holding portions of the base housing 1 in preferred embodiment is formed by the spaced first and second channels, the first and the second holding portions could be configured in other structures whichever can position/hold the first and the second connectors 200, 500.

Figure 7:
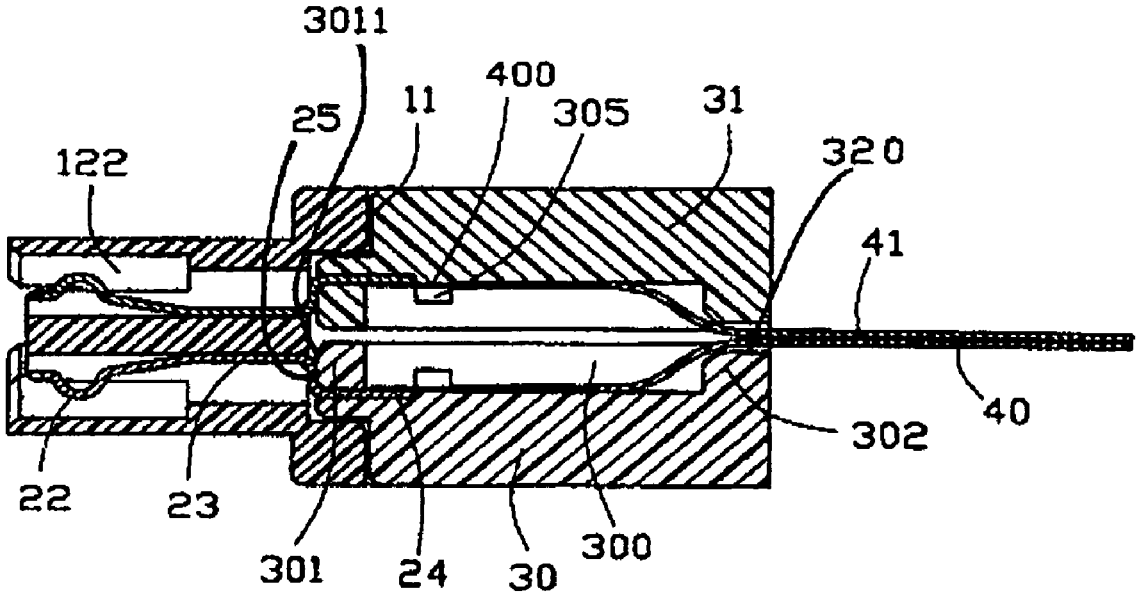
FIG. 7 is a cross-sectional view of FIG. 2 taken along line 7-7.
Figure 8:
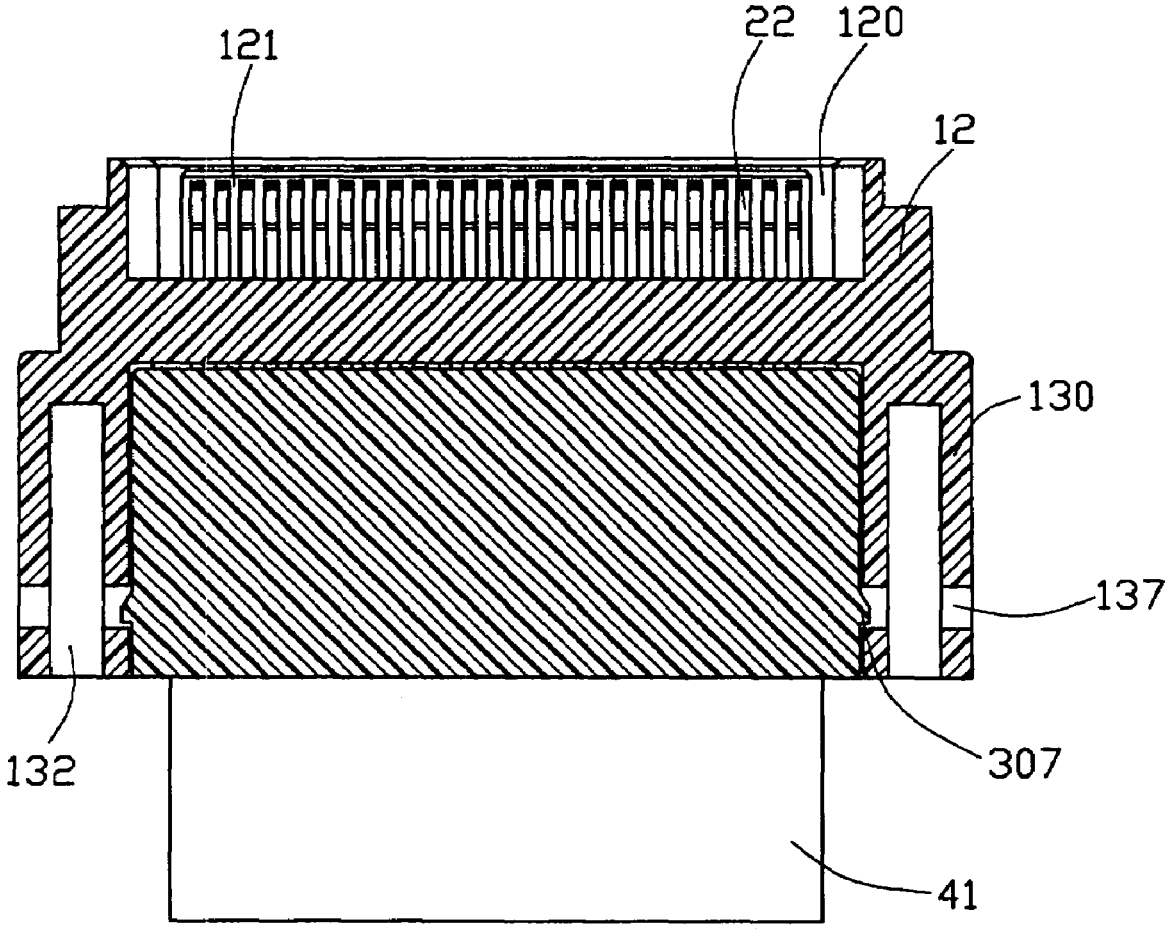
FIG. 8 is a cross-sectional view of FIG. 3 taken along line 8-8.

It is noted that as shown in FIG. 7, in each terminal 20 the retaining section 23 is offset from the tail section 24, and a middle section 25 between the retaining section 23 and the tail section 24 abuts against a front face 3011 of the insulative housing 30 to prevent rearward movement of the terminal 20 relative to the insulative housing 30. On the other hand, the first and second insulative housings 30 and 31 commonly define an exit 320 trough which the intimately joined first and second cables 40 and 41 extend as one unitary piece for exposure to an exterior.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an insulative base housing comprising a holding portion, the base housing defining an assessable mating interface having a plurality of passages arranged in a row;

a connector module having an insultive housing defining a plurality of partitions forming a plurality of holes each located between every adjacent two partitions, a plurality of terminals having corresponding tail sections respectively fitted in the corresponding through holes and have corresponding retaining sections outwardly projecting from one end of the housing and into the corresponding passages which is generally aligned with the corresponding through holes in a front-to-back direction, respectively, wherein the retaining section is generally offset from the tail section along the front-to-back direction with a middle section therebetween abutting against a front face of the insulative housing of the connector module; and a flat flexible cable including a plurality of wires respectively electrically and mechanically connected to the corresponding terminals; wherein said flat flexible cable and said connector module are horizontally assembled to the base.

2. The electrical connector assembly as claimed in claim 1, wherein the wires are connected to the corresponding terminals in the connector module.

* * * * *